US009687132B2

(12) United States Patent
Schlischka

(10) Patent No.: US 9,687,132 B2
(45) Date of Patent: Jun. 27, 2017

(54) MOBILE APPARATUS, PARTICULARLY AN AUTONOMOUSLY MOBILE FLOOR CLEANING DEVICE

(71) Applicant: Vorwerk & Co. Interholding GmbH, Wuppertal (DE)

(72) Inventor: Patrick Schlischka, Wuppertal (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 75 days.

(21) Appl. No.: 14/793,821

(22) Filed: Jul. 8, 2015

(65) Prior Publication Data

US 2016/0007817 A1 Jan. 14, 2016

(30) Foreign Application Priority Data

Jul. 10, 2014 (DE) ..... 10 2014 109 666
Jul. 31, 2014 (DE) ..... 10 2014 110 875

(51) Int. Cl.
*A47L 11/40* (2006.01)
*A47L 9/00* (2006.01)
*A47L 9/28* (2006.01)

(52) U.S. Cl.
CPC ..... *A47L 11/4061* (2013.01); *A47L 9/009* (2013.01); *A47L 11/4066* (2013.01);
(Continued)

(58) Field of Classification Search
CPC .. A47L 11/4061; A47L 9/009; A47L 11/4066; A47L 11/4072; A47L 9/2852; A47L 2201/04; Y10S 901/01
(Continued)

(56) References Cited

U.S. PATENT DOCUMENTS 3,273,193 A * 9/1966 Soderholm ..... A47L 11/00 15/320
3,909,869 A * 10/1975 Hukuba ..... A47L 11/33 15/41.1
(Continued)

FOREIGN PATENT DOCUMENTS

DE 20 2008 017 137 U1 3/2009
EP 2 679 130 A1 1/2014
(Continued)

OTHER PUBLICATIONS

European Search report in EP 15 17 4940 dated Dec. 18, 2015 with translation of relevant parts.

*Primary Examiner* — Karen Beck
(74) *Attorney, Agent, or Firm* — Collard & Roe, P.C.

(57) ABSTRACT

A mobile apparatus, particularly an autonomously mobile floor cleaning device, has a chassis and wheels, wherein at least one wheel is driven, and the driven wheel is connected to the chassis via a suspension element that supports the wheel and is movable relative to the chassis. In order to create an alternative mobile apparatus for negotiating an obstacle, the wheel for support on a subsurface over which the mobile apparatus can travel is influenced by a spring exerting a spring force and can be retracted and extended relative to the chassis with the aid of the suspension element, wherein the spring force is adjustable independently of an increase or decrease in the spring force caused by such extension or retraction, and in particular may be increased as the wheel is extended farther.

12 Claims, 12 Drawing Sheets

(52) U.S. Cl.
CPC ..... *A47L 11/4072* (2013.01); *A47L 9/2852* (2013.01); *A47L 2201/04* (2013.01); *Y10S 901/01* (2013.01)

(58) Field of Classification Search
USPC ..... 280/5.514; 15/319; 180/8.2
See application file for complete search history.

(56) References Cited

U.S. PATENT DOCUMENTS

| | | | | |
|---|---|---|---|---|
| 2004/0049877 | A1* | 3/2004 | Jones | A47L 5/30 15/319 |
| 2007/0016328 | A1* | 1/2007 | Ziegler | A47L 5/14 700/245 |
| 2008/0066257 | A1* | 3/2008 | Sun | A47L 5/14 15/319 |
| 2008/0256743 | A1* | 10/2008 | Lam | A47L 9/0494 15/329 |
| 2010/0243344 | A1* | 9/2010 | Wyrobek | B25J 5/007 180/21 |

FOREIGN PATENT DOCUMENTS

| | | | |
|---|---|---|---|
| JP | 2006155274 | A | 6/2006 |
| WO | 2013/034884 | A1 | 8/2012 |

* cited by examiner

MOBILE APPARATUS, PARTICULARLY AN AUTONOMOUSLY MOBILE FLOOR CLEANING DEVICE

CROSS REFERENCE TO RELATED APPLICATIONS

Applicant claims priority under 35 U.S.C. §119 of German Application No. 102014109666.5 filed Jul. 10, 2014 and German Application No. 102014110875.2 filed Jul. 31, 2014, the disclosures of which are incorporated by reference.

BACKGROUND OF THE INVENTION

1. Field of the Invention

The invention relates to a mobile apparatus comprising a chassis and a plurality of wheels, wherein at least one wheel is driven, and the driven wheel is connected to the chassis via a suspension element that supports the wheel and is movable relative to the chassis. The mobile apparatus may particularly be an autonomously mobile floor cleaning device.

2. Description of the Related Art

Mobile apparatuses of the kind described above are known in the prior art. They may be for example autonomously mobile floor cleaning devices such as robot vacuum cleaners. In order to be able to clean a room thoroughly, for example, the mobile apparatus must also be able to negotiate obstacles. This applies for example to climbing onto a carpet that is raised above the level of the rest of the subsurface. In particular, it is known to fit mobile apparatuses with special equipment that enables them to negotiate such obstacles. For example, the prior art includes examples of mobile apparatuses having a kind of lifting mechanism, with which the mobile apparatus can be raised onto the obstacle in question. The lifting mechanism is activated when an obstacle is encountered, particularly effected by a system for monitoring the surroundings of the mobile apparatus for the presence of such obstacles.

For example, German patent no. DE 202008017137 U1 describes such a travelling cleaning device which is equipped with a lifting mechanism having two sets of swivelling arms and arranged on a base plate of the cleaning device. The swivelling arms in a swivelling arm set extend parallel to one another and are unfolded and folded up by a drive unit with a gearbox. When the cleaning device is used on an obstacle-free subsurface, the swivelling arms remain in the folded position, and cleaning device moves around on the wheels disposed on the swivelling arms. As soon as the sensors in a monitoring device detect an obstacle, the swivelling arms closest to the obstacle are unfolded so that they are resting on top of it and can lift the floor cleaning device over the level difference. As soon as the cleaning device has passed the obstacle, the swivelling arms are folded together again, so that the cleaning device returns to the original state for flat subsurfaces.

Although mobile apparatuses of this kind have proven to be quite capable of negotiating an obstacle, the lifting mechanism described is complicated to manufacture, which also makes it particularly expensive. Accordingly, the same also applies for the mobile apparatus as whole, i.e. a floor leaning device, for example.

SUMMARY OF THE INVENTION

The object of the invention is therefore to create an alternative mobile apparatus for overcoming an obstacle, which requires the smallest possible number of technical elements and can therefore be manufactured with little effort and at low cost.

To solve the object as stated above, the invention provides a mobile apparatus, particularly an autonomously mobile floor cleaning device, having a chassis and a plurality of wheels, wherein at least one wheel is driven, and the driven wheel is connected to the chassis via a suspension element that supports wheel and is movable relative to the chassis, wherein the wheel for support on a subsurface over which the mobile apparatus can travel is placed under tension by a spring exerting a spring force and can be retracted and extended relative to the chassis with the aid of the suspension element, and wherein the spring force is adjustable independently of an increase or decrease in the spring force caused by such extension or retraction, and in particular may be increased as the wheel is extended farther.

With the design described in the preceding, the mobile apparatus is able to carry out its task entirely without any complicated, separate lifting mechanism. The wheel of the mobile apparatus also remains in its current position relative to the chassis. Thus, complicated modifications are not necessary.

Negotiation of an obstacle is enabled essentially be a situation-dependent increase in the contact pressure of the wheel on the subsurface. In this context, the mechanism according to the invention with a spring exerting a variable spring force on the wheel is particularly simple and inexpensive.

While the mobile apparatus, i.e., the floor cleaning device for example, travels on a flat, obstacle-free surface, the spring is under tension and the contact pressure of the wheels on the subsurface generated by the weight of the device itself is sufficient. But if the mobile apparatus then encounters a thicker carpet, for example, this additional bearing point causes the weight to be distributed to a larger number of bearing points, and because of the consequent reduction of the load on the wheels, the spring causes the suspension element to swivel, thereby extending the wheels out of chassis, with the result mobile apparatus increases its previous clearance above the floor. This enables the mobile apparatus to push farther onto the obstacle; but then the force of the spring is now reduced in accordance with the spring characteristic curve thereof as the swivelling of the suspension element removes the tension from the spring, and as the bearing area on the obstacle becomes larger, the contact pressure of the wheels is no longer sufficient to continue the advance.

Since it has been found in practice that this reduced contact pressure and the accompanying floor grip are not strong enough to enable the apparatus to negotiate the obstacle reliably, in future the spring force will be adjusted without reference to the swivelling position of the suspension element, thereby increasing the contact pressure so that the wheel has sufficient purchase on the floor and is able to travel over the obstacle reliably.

As an alternative to the mode of functioning described above, according to which the mobile apparatus remains substantially horizontal, the mobile apparatus may also tilt in response to a change of momentum when it runs into an obstacle. In such a case, the suspension element is swivelled. Since the wheel is governed by the spring force, this causes it to extend relative to the chassis, and the distance between the chassis and the subsurface increases. At the same time, the load on the spring is reduced, which usually lowers contact pressure of the wheel. Then, the force of the spring is altered independently of the reduction in spring force caused by the extension of the wheel, that is to say, also independently of the degree to which the mobile apparatus is tilted or the swivel position of the suspension element.

It is provided that the spring force of the spring is automatically adjustable. Thus, a mobile apparatus is created that is capable of travelling over obstacles as well as flat subsurfaces without a user having to intervene to assist the mobile apparatus, because the mobile apparatus has become stuck in front of an obstacle, for example, or it persists in avoiding an obstacle that it is required to travel over in order to complete a thorough cleaning of the area.

The spring force is advantageously adjustable according to a distance, particularly a distance between the chassis and the subsurface, which is captured by a sensor and corresponds to a dimension of the wheel retraction or extension. In this operation, the sensor captures a distance that corresponds to the dimension of wheel retraction or extension relative to the chassis. For example, this may be the distance between the chassis and the subsurface, or also the distance between the chassis and the axis of rotation of the wheel. Other distances providing an indication of the dimension of wheel retraction or extension are also conceivable for the purposes of the invention.

Alternatively or additionally, it may also be provided that the mobile apparatus is equipped with an obstacle detection system, which initiates the change in spring force. In such a case, the spring force may be adapted as soon as an obstacle is detected, before the mobile apparatus comes into physical contact with it. Since the necessary preparations for negotiating the obstacle have been made in advance, the situation may thus be avoided in which the mobile apparatus encounters an obstacle and only then begins to set the necessary spring force. This is very helpful in saving time. If an obstacle is detected by the obstacle detection system, which may include an acoustic, optical or capacitive sensor for example, the spring force is advantageously increased automatically, so that the necessary contact pressure of the wheel on the subsurface is available, enabling the mobile apparatus to reliably negotiate the obstacle.

The spring force may be adjustable in various ways within the scope of the invention. For example, the spring may be a gas pressure spring, so the spring force can be adjusted particularly easily by means of the gas pressure. Alternatively, it is also possible for the spring to have the form of a spring element acting in response to elastic deformation, for example. Such a spring element is a helical spring, for example, which undergoes deformation—thus increasing the spring force—upon deflection. Spring elements of such kind are particularly inexpensive and require very little maintenance.

It may further be provided that the spring has one connection point on the chassis side and one connection point on the wheel side, wherein a distance between the connection points is a decisive factor for the spring force. The spring is thus connected to both the chassis and the wheel, particularly to the suspension element supporting the wheel. In this way, if the spring is shortened by a swivelling movement of the suspension element, for example, causing a reduction in the spring force, the spring force may be increased again by a change in the distance between the connection points.

It is essential for the purposes of the invention that the distance between the connection points be adjustable in order to change the spring force. Generally in this context, the distance between the connection points may be varied either by shifting the connection point on the chassis side, or by shifting the connection point on the wheel side, or by shifting both at the same time.

According to an advantageous variant of the invention, the suspension element is a swing arm which is attached in articulated manner to the chassis so as to be rotatable about an axis of rotation, and to which the wheel is attached at a distance from the axis of rotation thereof. In this context, the connection point of the spring on the wheel side is advantageously arranged on the swing arm, so that the spring force can be adjusted in all cases by a swivelling movement of the swing arm. Thus, the swing arm as suspension element not only performs the function of a retracting and extending the wheel, but also that of changing the spring force by applying pressure to and relieving pressure from the spring.

For the purpose of providing the contact pressure necessary for successfully negotiating an obstacle, according to the invention either the connection point on the chassis side or the connection point on the wheel side may be displaced relative to the chassis, and thus also the suspension element, wherein the distance that is decisive for the effective spring force is changed.

It is particularly provided within the scope of the invention that the connection point on the chassis side or the connection point on the wheel side is shifted by means of a gear drive. In this context, said gear drive for example has a first toothed element arranged on the chassis and a second toothed element in operative connection therewith, wherein the second toothed element may also be arranged on the chassis. The first toothed element may be a gearwheel, for example, whereas the second toothed element is a linear toothed element that is tangential with and operatively connected to the first toothed element, i.e., the gearwheel. The first toothed element is advantageously driven by a motor, which is activated when an obstacle is encountered. The movement of the motor is advantageously controlled via a corresponding detection device. Alternatively, the first toothed element may also be supported on the suspension element, for example. In this case, actuation of the gear drive may initiate both the swivelling of the suspension element about its axis of rotation and a change in the spring force.

The gear drive serves to fine-tune the distance between the connection point on the chassis side and the connection point on the wheel side and set a spring force that is capable of increasing the contact pressure of the wheel on the subsurface so that the mobile apparatus can negotiate an obstacle without difficulty.

The gear drive is advantageously connected to an electric drive unit. This electric drive unit may be a linear drive unit, for example, and in particular a servodrive unit. The electric drive unit can be used in conjunction with the described gearwheel mechanism particularly easily, wherein the first toothed element is driven by the electric motor.

Finally, the spring according to the invention may also be a length-adjustable spring strut, so that the spring force may also be adjusted by varying the length of the spring strut, particularly in similar manner to a coilover suspension.

BRIEF DESCRIPTION OF THE DRAWINGS

In the following, the invention will be explained in greater detail with reference to an embodiment thereof. In the drawing.

DETAILED DESCRIPTION OF PREFERRED EMBODIMENTS

Figure 1:
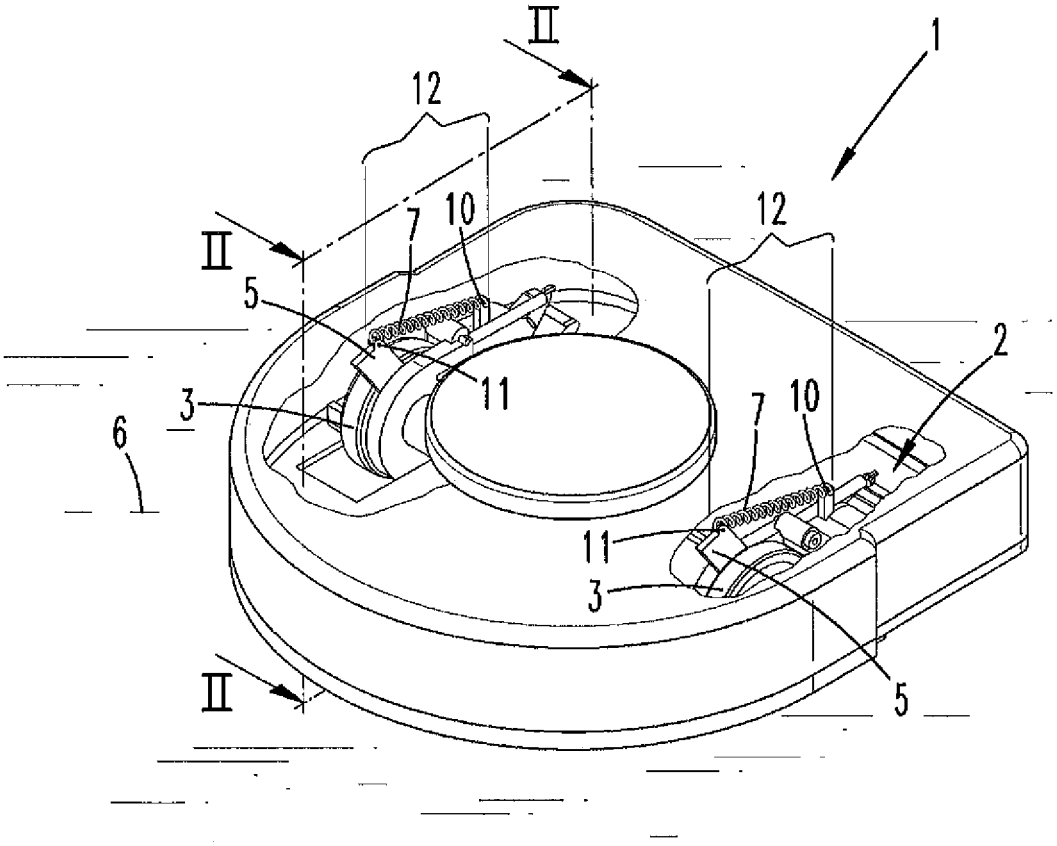
FIG. 1 shows a mobile apparatus according to the invention.

FIG. 1 shows a 3D view of a mobile apparatus 1—in this case a floor cleaning device—according to the invention. Mobile apparatus 1 has a chassis 2 and two wheels 3 arranged thereon. Mobile apparatus 1 is enclosed in a housing, which defines the outer appearance of mobile apparatus 1. Wheels 3 are each connected to a suspension element 5. A spring 7 is arranged between suspension element 5 (more precisely: on a connection point 11 on the wheel side) and chassis 2 (more precisely: on a connection point 10 on the chassis).

FIGS. 2 to 6 relate to a first embodiment of the invention, which will be explained in the following.

Figure 2:
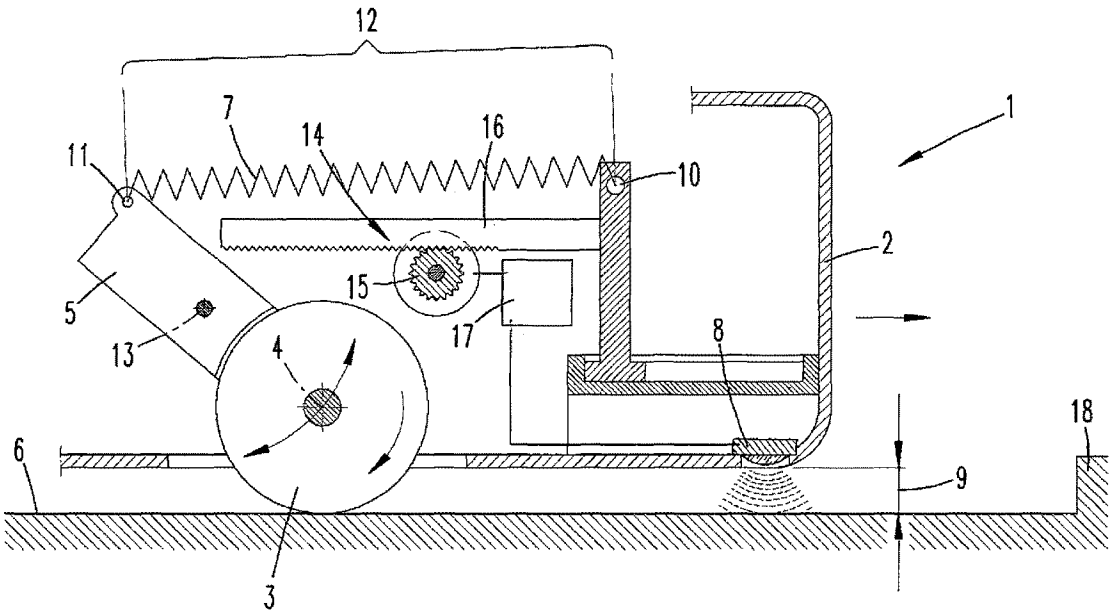
FIG. 2 is a cross sectional view of a first embodiment of the mobile apparatus.
Figure 2A:
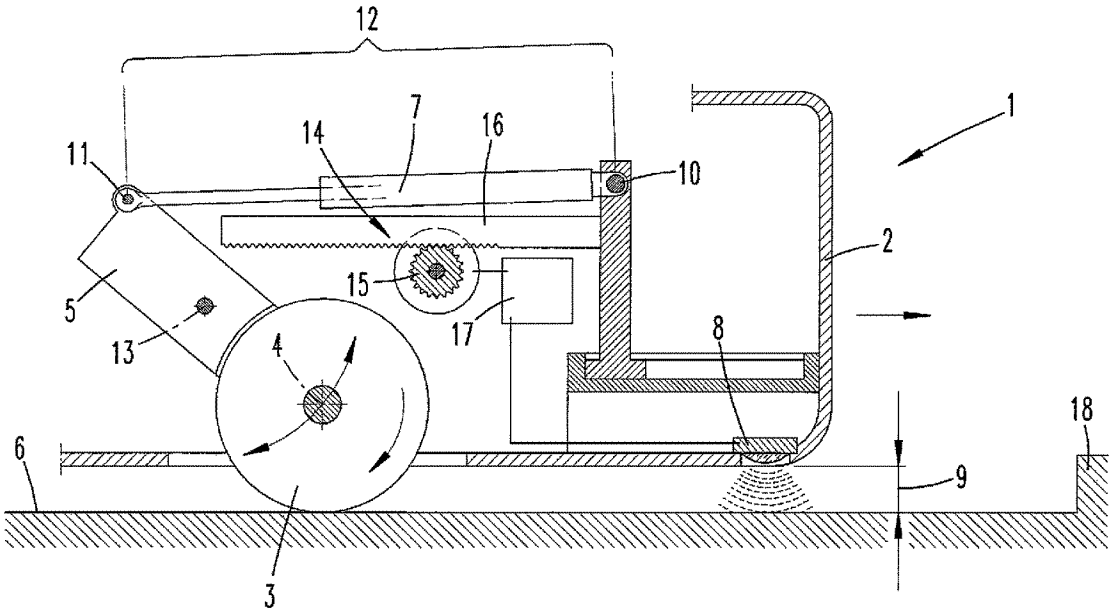
FIG. 2*a* is a cross sectional view of an embodiment of the mobile apparatus in which the spring is a gas pressure spring.

FIG. 2 is a cross sectional representation of a mobile apparatus 1 according to the invention for exemplary purposes. The cross sectional view shows a chassis 2 connected to a wheel 3. Wheel 3 is connected to suspension element 5 so as to be rotatable about a wheel axle 4. Suspension element 5 is rotatable about an axis of rotation 13 arranged on chassis 2 in such manner that wheel 3 can swivel relative to chassis 2. A spring 7 is under pretension between connection point 10 on the chassis side and connection point 11 on the wheel side, which is arranged on the end area of suspension element 5 farthest from wheel 3. A gear drive 14 with a first toothed element, specifically a gearwheel 15, and a second toothed element, specifically a linear toothed element 16, for example, is disposed on chassis 2, close to connection point 10 on the chassis side. Gear drive 14 is connected to a drive unit 17. Drive unit 17 may include an electric motor and a motor controller, for example. The motor controller is connected to a sensor 8, which measures distance 9 between a predefined plane of sensor 8 and subsurface 6, for example. Distance 9 between chassis 2 and subsurface 6 is a result of the weight force of mobile apparatus 1 acting on wheel 3 and of the force of the force of spring 7 that swivels wheel 3 out of chassis 2. Spring 7 may be a gas pressure spring as shown in FIG. 2*a*.

Figure 3:
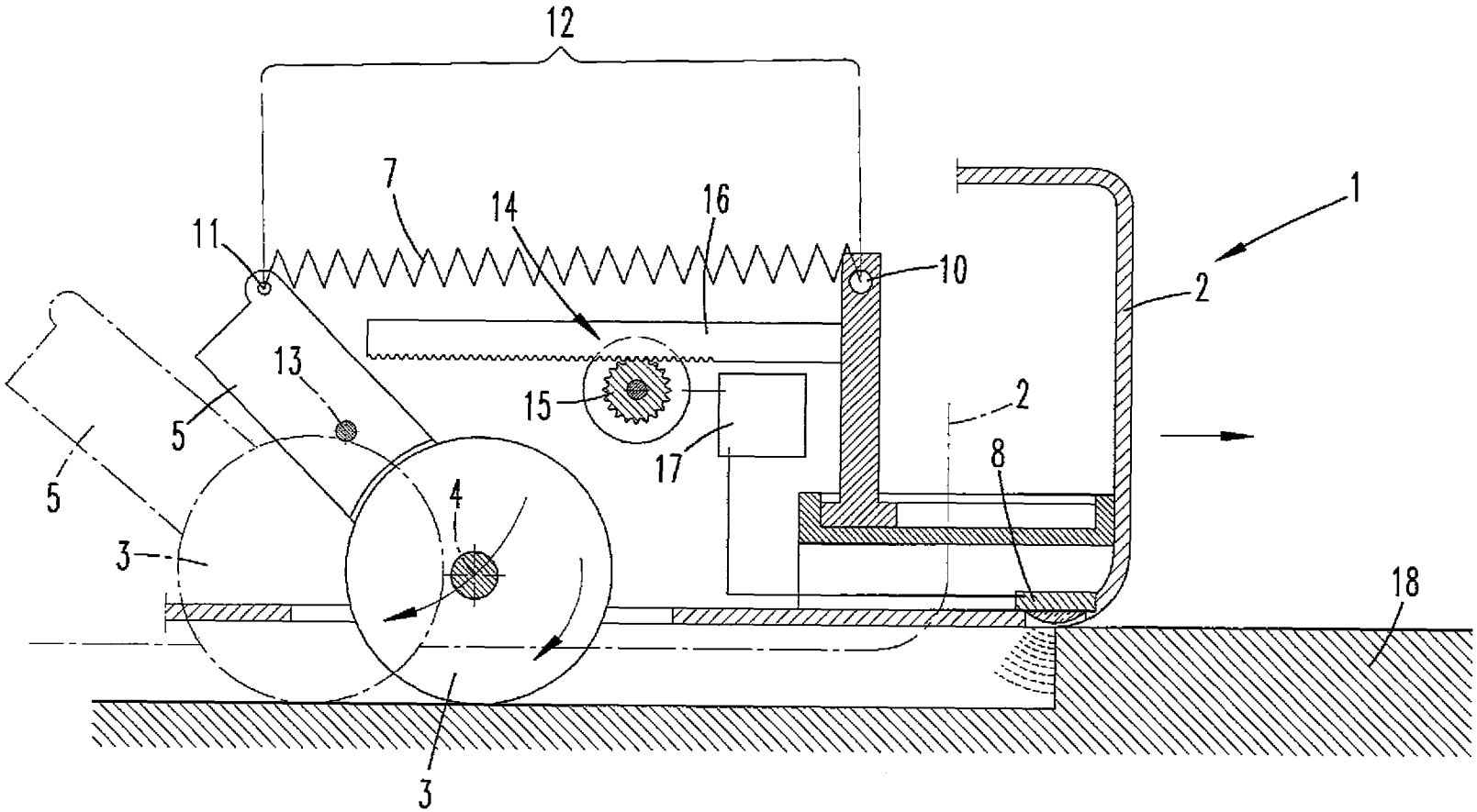
FIG. 3 shows the mobile apparatus according to a first embodiment in front of an obstacle.

FIG. 3 shows a mobile apparatus 1 that has physically encountered an obstacle 18. Obstacle 18 may be for example a carpet which is significantly higher than the subsurface 6 beneath it. The zone of chassis 2 that is in front of wheel 3 in the direction of travel is pushed onto obstacle 18 before wheel 3 comes into contact with the edge of obstacle 18. Consequently, some of the weight of chassis 2 is transferred to obstacle 18, so that spring 7 is able to swivel wheel 3 farther out of chassis 2. Since chassis 2 is supported on obstacle 18, however, the contact pressure of wheel 3 on subsurface 6 is reduced at the same time. For this reason, it is provided for sensor 8 to measure the now smaller distance 9 from obstacle 18. An evaluation unit (not shown) compares the measured distance 9 with a previously measured distance 9, and if the current distance 9 is smaller, deduces the presence of an obstacle 18. Sensor 8 may be for example an acoustic (e.g., ultrasonic sensor), optical or capacitive sensor. However, other types of sensor 8 are also conceivable.

Figure 4:
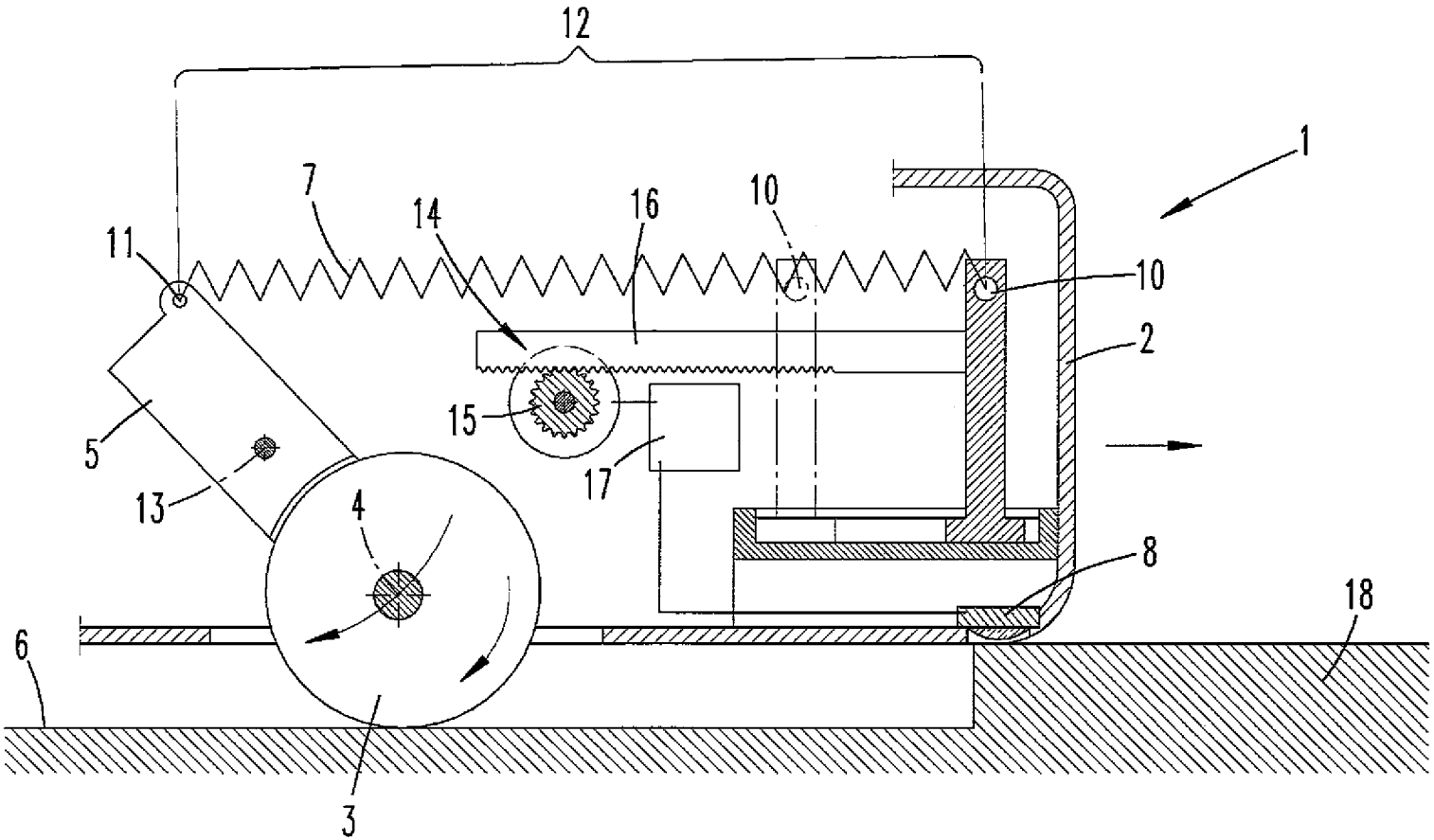
FIG. 4 shows the mobile apparatus of FIG. 3 with the spring under tension according to a first embodiment.
Figure 5:
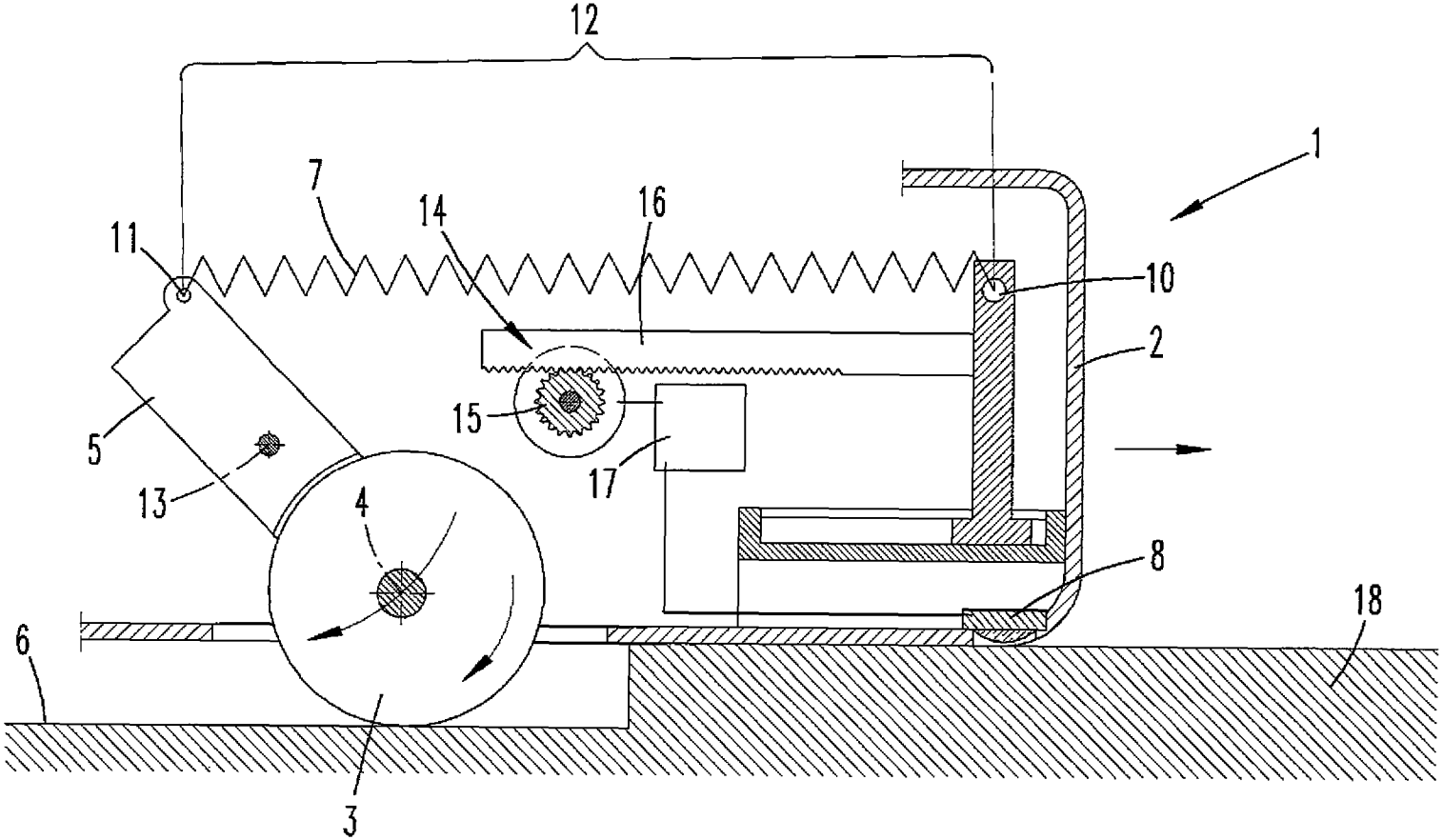
FIG. 5 shows the mobile apparatus negotiating the obstacle according to a first embodiment.

As shown in FIG. 4, if an obstacle 18 is detected, spring 7 is placed under tension, thereby increasing its spring force. For this purpose, the evaluation unit transmits the information about the presence of an obstacle 18 to a drive unit 17, which also contains a motor controller. Drive unit 17 controls the movement of the gear drive 14 disposed on chassis 2. This causes gearwheel 15 to turn. The rotation of gearwheel 15 is transmitted to linear toothed element 16, causing chassis side connection point 10 of spring 7 to shift so as to place spring 7 under tension and increase the spring force thereof. Alternatively, it would also be possible to shift the wheel side connection point 11 of spring 7, by shifting the position of wheel 3 relative to chassis 2, for example. The tension on spring 7, i.e., the greater spring force, also increases the force acting on suspension element 5, which force attempts to pull the part of suspension element 5 on which wheel side connection point 11 is located towards chassis side connection point 10. At the same time, the effect of axis of rotation 13 of suspension element 5 causes wheel 3 to be pressed against subsurface 6. This enables wheel 3 to exert sufficient contact pressure on subsurface 6 to raise chassis 2 slightly above obstacle 18, thereby reducing frictional losses. Consequently, chassis 2 can be pushed farther over obstacle 18 until finally wheel 3 rolls up onto obstacle 18. This is shown in FIG. 5.

Figure 6:
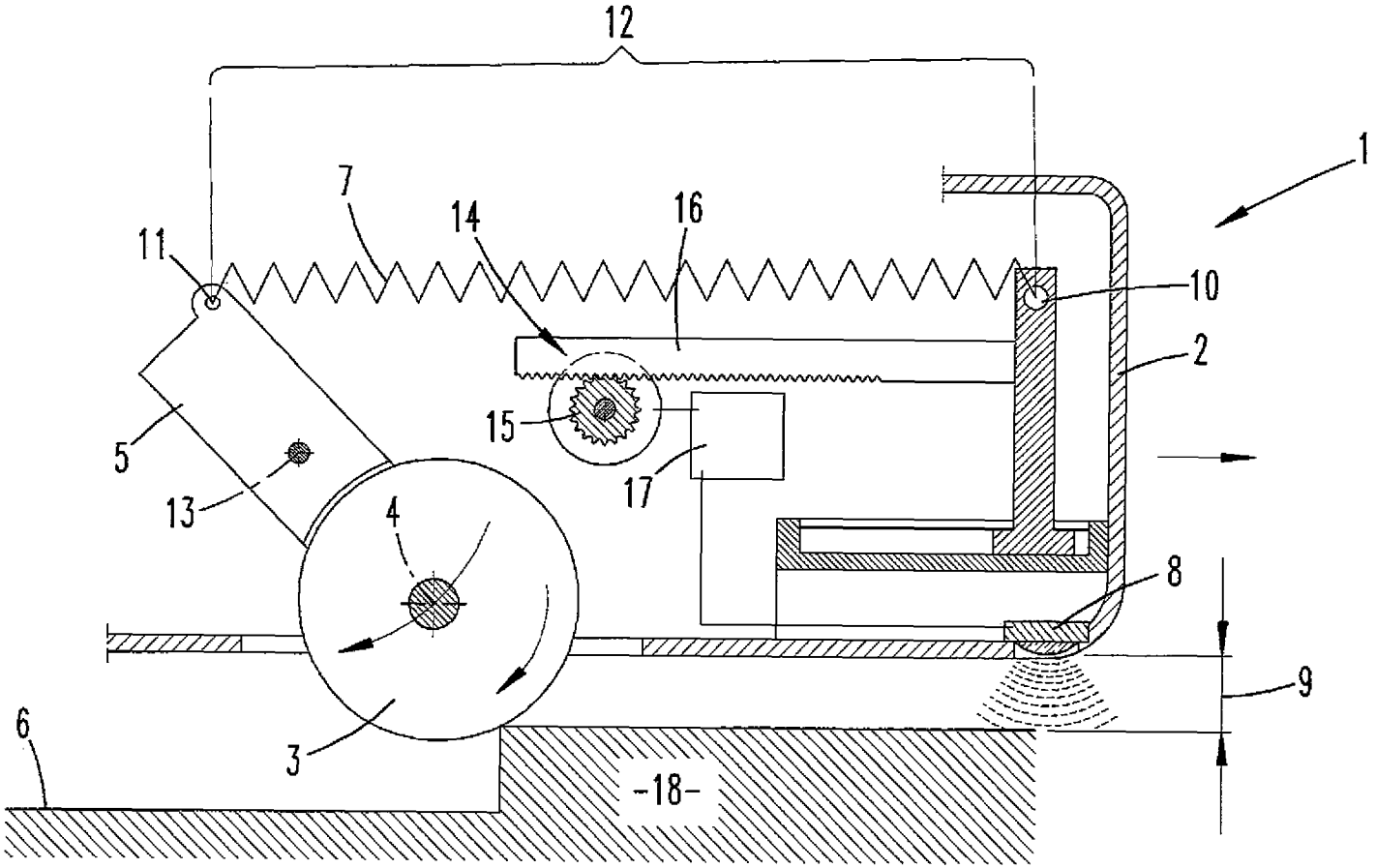
FIG. 6 shows the mobile apparatus in a later stage of negotiating the obstacle according to a first embodiment

As shown in FIG. 6, mobile apparatus 1 has advanced far enough so that wheel 3 is in direct contact with obstacle 18. Spring 7 is still under tension, and thus maintains the contact pressure of wheel 3 against subsurface 6, that is to say obstacle 18, enabling mobile apparatus 1 to climb the edge between subsurface 6 and obstacle 18 and move on top of obstacle 18.

As soon as mobile apparatus 1 is positioned on top of obstacle 18, sensor 8 for example may detect the change in distance 9, whereupon evaluation unit advantageously causes drive unit 17 to rotate gear drive 14 in the opposite direction, so that distance 12 between chassis side connection point 10 and wheel side connection point 11 is reduced again. This in turn reduces the deflection of spring 7, so that the spring force decreases and wheel 3 can be retracted towards chassis 2 again by suspension element 5.

FIGS. 7 to 11 relate to a second embodiment of the invention. The essential differences between this second embodiment and the first embodiment are explained in the following.

Figure 7:
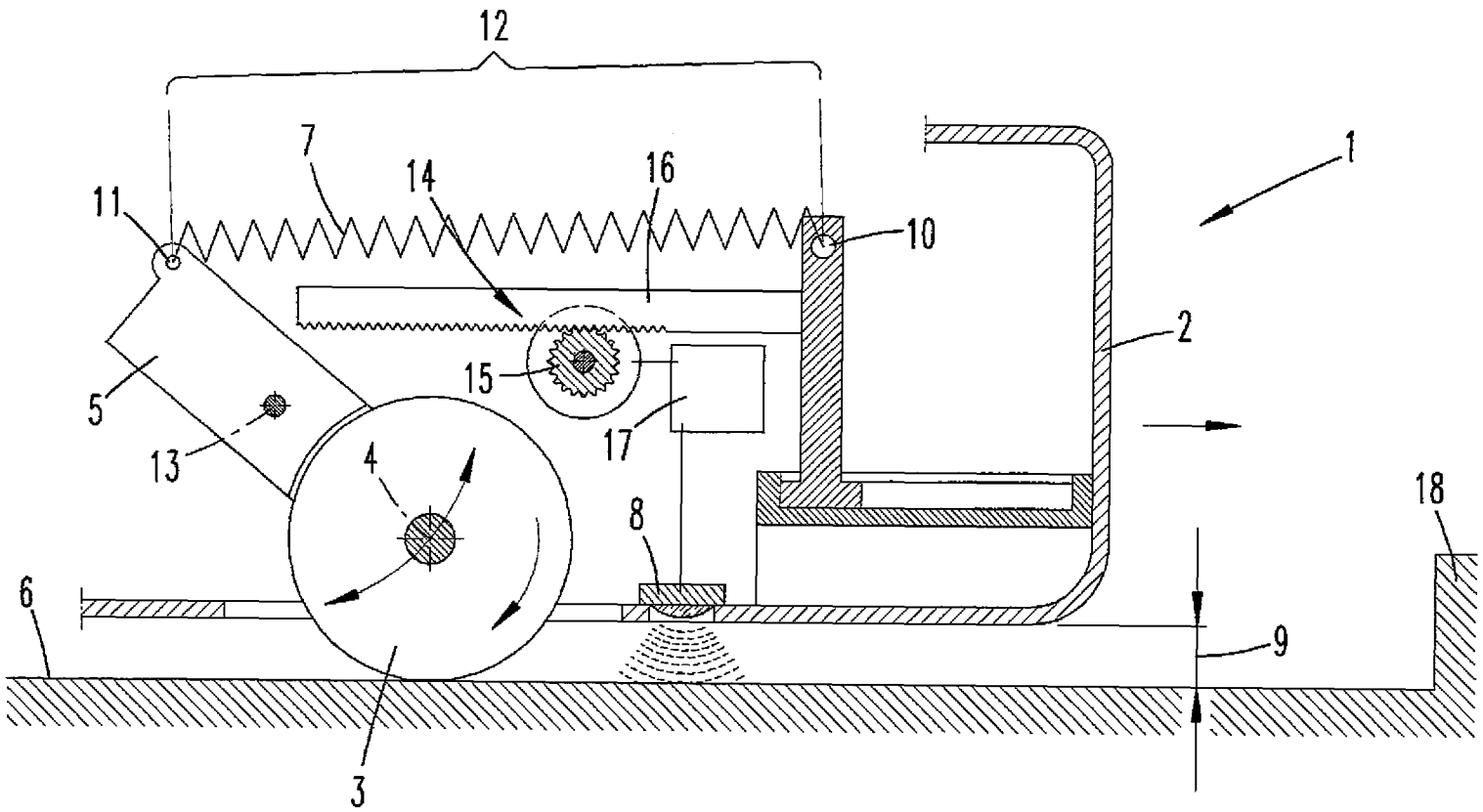
FIG. 7 is a cross sectional view of a second embodiment of the mobile apparatus.

FIG. 7 shows a mobile apparatus 1 according to a second embodiment. Mobile apparatus 1 has a chassis 2 with a wheel 3 that is connected to a suspension element 5 so as to be rotatable about a wheel axle 4. Suspension element 5 is rotatable about an axis of rotation 13 arranged on chassis 2 in such manner that wheel 3 can be swivelled relative to chassis 2. A spring 7 is under pretension between connection point 10 on the chassis side and connection point 11 on the wheel side, which is arranged on the end area of suspension element 5 farthest from wheel 3. A gear drive 14 with a first toothed element, specifically a gearwheel 15, and a second toothed element, specifically a linear toothed element 16, is disposed on chassis 2. Gear drive 14 is connected to a drive unit 17. A sensor 8 is also arranged on chassis 2, and is able to measure distance 9 to a subsurface 6 below chassis 2, for example. Sensor 8 is arranged farther inwards on the chassis than in the mobile apparatus 1 according to the first embodiment, which means that sensor 8 is closer to wheel 3 and closely follows a leading region of chassis 2.

Figure 8:
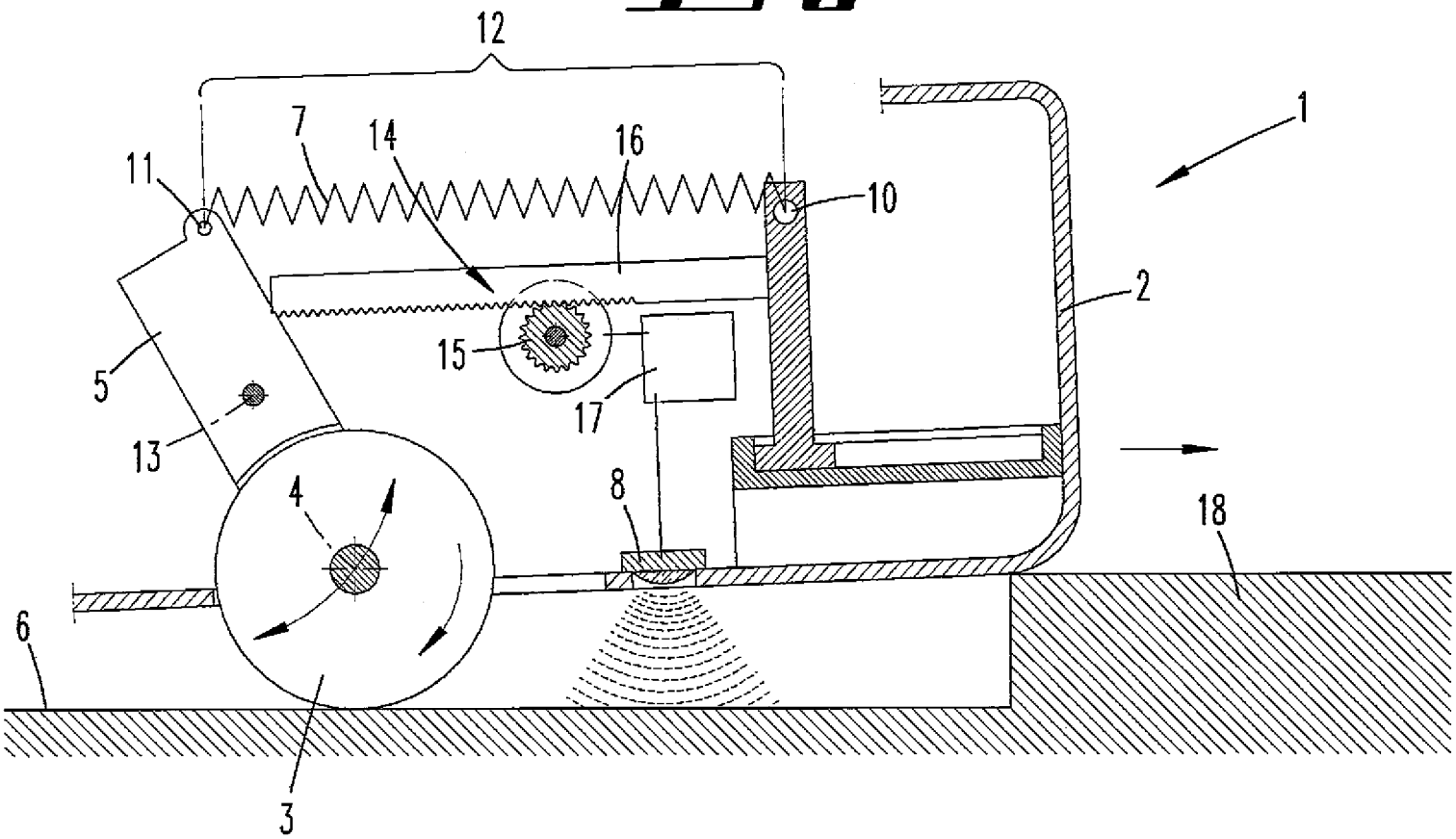
FIG. 8 shows the mobile apparatus according to a second embodiment in front of an obstacle.

FIG. 8 shows mobile apparatus 1 on an obstacle 18. A leading region of chassis 2 in the front of mobile apparatus 1 is in contact with obstacle 18. Wheel 3 of mobile apparatus 1 travels as far as the edge of obstacle 18. This causes mobile apparatus 1 to tilt and the leading region of chassis 2 comes to rest on top of obstacle 18. This tilting causes wheel 3 to be extended relative to chassis 2 by the action of the spring force of spring 7 assisted by suspension element 5, so that the distance between sensor 8 and subsurface 6 is increased. This increased distance 9 is measured by sensor 8, and an evaluation unit (not shown) compares the measured distance with a reference distance representing the measured distance when an obstacle 18 is not present, and determines that an obstacle 18 exists if the distance has currently increased. Sensor 8 may be an acoustic, optical or capacitive sensor, for example. Other types of sensor 8 are also conceivable.

Figure 9:
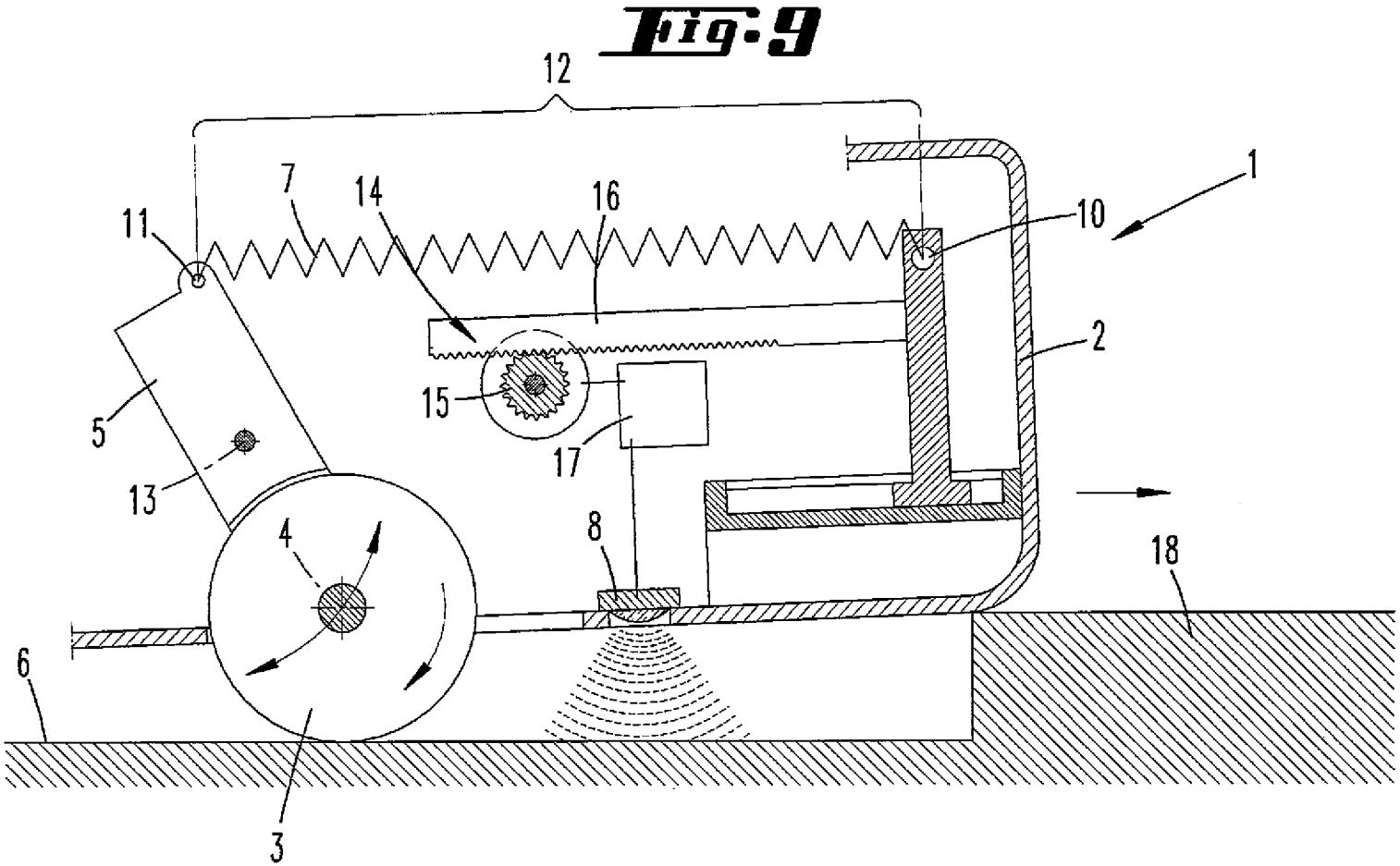
FIG. 9 shows the mobile apparatus of FIG. 8 with the spring under tension according to a second embodiment.
Figure 10:
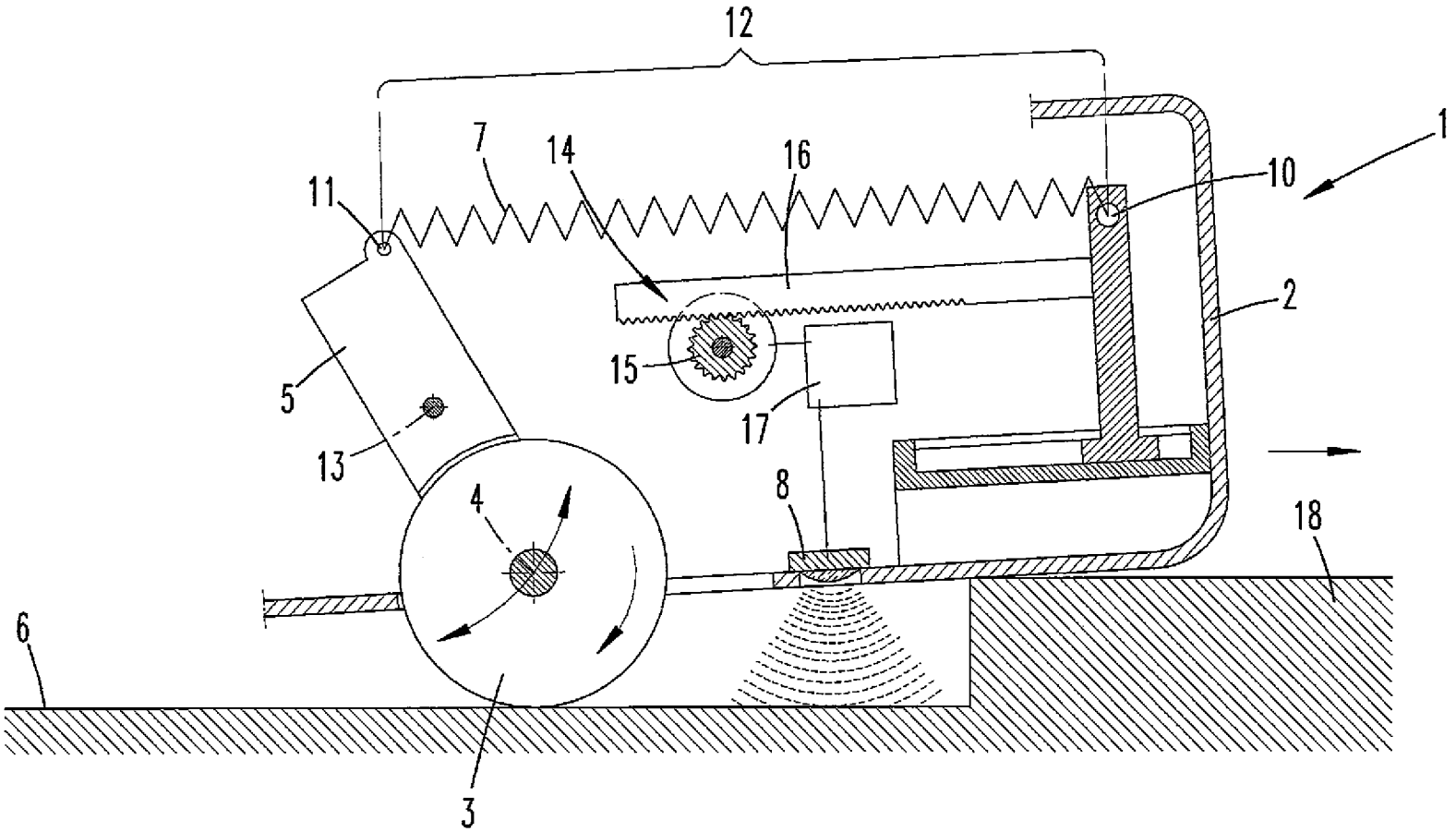
FIG. 10 shows the mobile apparatus negotiating the obstacle according to a second embodiment.

As shown in FIG. 9, when an obstacle 18 is detected, spring 7 is placed under tension, thereby increasing the spring force. A mechanism designed to perform this task was described previously with reference to the first embodiment (FIG. 4). The tension of spring 7 also increases the force acting on suspension element 5, which force attempts to pull the part of suspension element 5 on which wheel side connection point 11 is located towards chassis side connection point 10. At the same time, the effect of axis of rotation 13 of suspension element 5 causes wheel 3 to be pressed against subsurface 6. This enables wheel 3 to exert sufficient contact pressure on subsurface 6 to raise chassis 2 farther above obstacle 18. This is shown in FIG. 10.

Figure 11:
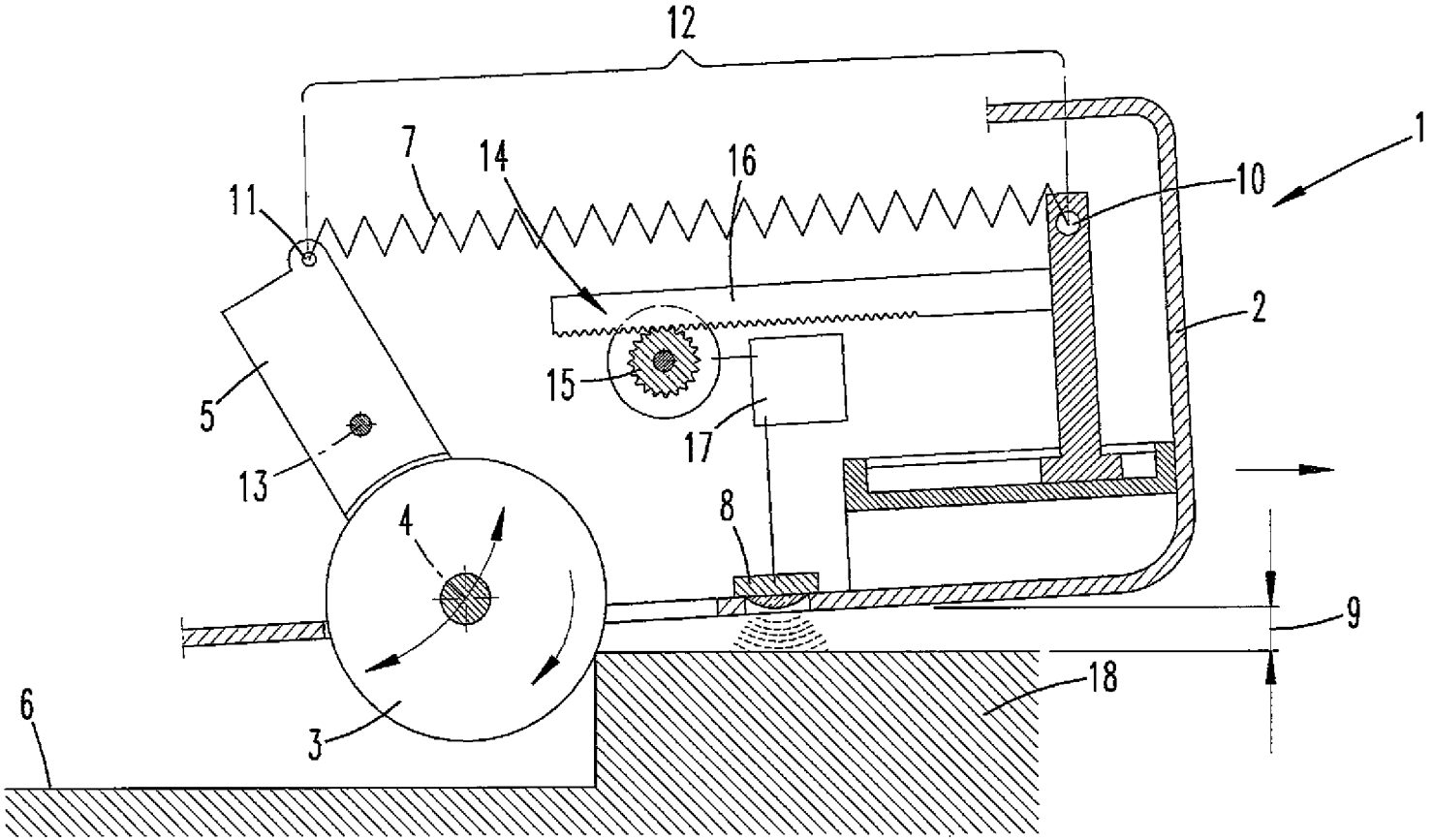
FIG. 11 shows the mobile apparatus in a later stage of negotiating the obstacle according to a second embodiment.

According to FIG. 11, mobile apparatus 1 has finally advanced far enough so that wheel 3 is in direct physical contact with obstacle 18. Spring 7 is still under tension and maintains the contact pressure of wheel 3 on subsurface 6, that is to say on obstacle 18, enabling mobile apparatus 1 to climb the edge between subsurface 6 and obstacle 18 and move on top of obstacle 18. As soon as mobile apparatus 1 is positioned completely on top of obstacle 18, chassis 2 is tilted back into its horizontal original position (not shown). Sensor 8 then detects the changed distance 9, for example, and the evaluation unit advantageously causes drive unit 17 to turn gear drive 14 in the opposite direction so that distance 12 between chassis side connection point 10 and wheel side connection point 11 is reduced again. This in turn decreases the deflection of spring 7, so the spring force is reduced and wheel 3 can be retracted relative to chassis 2 again with the aid of suspension element 5.

LIST OF REFERENCE NUMERALS

1 Mobile apparatus
2 Chassis
3 Wheels
4 Wheel axle
5 Suspension element
6 Subsurface
7 Spring
8 Sensor
9 Distance
10 Connection point on the chassis side
11 Connection point on the wheel side
12 Distance
13 Axis of rotation
14 Gear drive
15 Gearwheel
16 Linear toothed element
17 Drive unit
18 Obstacle

What is claimed is:

1. Mobile apparatus, having a chassis and a plurality of wheels, wherein at least one wheel is driven, and the driven wheel is connected to the chassis via a suspension element that supports the driven wheel and is movable relative to the chassis, wherein the driven wheel for support on a subsurface over which the mobile apparatus can travel is influenced by a spring exerting a spring force and can be retracted and extended relative to the chassis with the aid of the suspension element, and wherein the spring force is adjustable independently of an increase or decrease in the spring force caused by such extension or retraction and independently of the degree to which the mobile apparatus is tilted.

2. Mobile apparatus according to claim 1, wherein the spring force is adjustable automatically.

3. Mobile apparatus according to claim 1, wherein the spring force can be adjusted on the basis of a distance corresponding to a retraction or extension dimension captured by a sensor.

4. Mobile apparatus according to claim 1, wherein the spring is a gas pressure spring.

5. Mobile apparatus according to claim 1, wherein the spring is designed as a spring element whose action is determined by elastic deformation.

6. Mobile apparatus according to claim 1, wherein the spring has a chassis side connection point and a wheel side connection point, and wherein the distance between the chassis side connection point and the wheel side connection point is decisive for the spring force.

7. Mobile apparatus according to claim 6, wherein the distance between the chassis side connection point and the wheel side connection point can be changed to adjust the spring force.

8. Mobile apparatus according to claim 6, wherein the suspension element is a swing arm that is attached in articulated manner to the chassis so as to be rotatable about an axis of rotation, and to which the driven wheel is attached at a distance from the axis of rotation.

9. Mobile apparatus according to claim 8, wherein the wheel side connection point is arranged on the swing arm.

10. Mobile apparatus according to claim 6, wherein a connection point can be shifted relative to the chassis and/or the suspension element to change the spring force by altering a distance between the chassis side connection point and the wheel side connection point, which is decisive for changing the effect of the spring force.

11. Mobile apparatus according to claim 1, wherein the spring force may be increased as the driven wheel is extended farther.

12. Mobile apparatus according to claim 3, wherein the distance is between the chassis and the subsurface.

* * * * *